US005991941A

United States Patent [19]

Rivet

[11] Patent Number: 5,991,941

[45] Date of Patent: Nov. 30, 1999

[54] BATHTUB/SHOWER DEFLECTOR

[76] Inventor: Yvan Rivet, 79-B rue St-Patrice Est., Magog, Quebec, Canada, J1X 1T5

[21] Appl. No.: 08/770,375

[22] Filed: Nov. 29, 1996

[51] Int. Cl.[6] ..... A47K 3/22

[52] U.S. Cl. ..... 4/609

[58] Field of Search ..... 4/558, 607, 608, 4/609, 610, 612, 614; 264/209.1

[56] References Cited

U.S. PATENT DOCUMENTS

| | | | |
|---|---|---|---|
| 1,807,107 | 5/1931 | Sternbergh | 4/609 X |
| 3,195,184 | 7/1965 | Svec | 264/209.1 X |
| 3,737,921 | 6/1973 | Baumrind | 4/609 |
| 3,952,337 | 4/1976 | Hansow | 4/609 X |
| 4,887,324 | 12/1989 | Cairns | 4/609 |

FOREIGN PATENT DOCUMENTS

| | | | |
|---|---|---|---|
| 0615716 | 9/1994 | European Pat. Off. | 4/610 |

*Primary Examiner*—Robert M. Fetsuga
*Attorney, Agent, or Firm*—Eric Fincham

[57] ABSTRACT

There is provided a splash guard for use with bathtubs or other enclosures for showering, the splash guard comprising a unitary member having an end wall, first and second side walls extending outwardly from the end wall, one of the side walls extending arcuately inwardly to meet the second side wall at their respective distal ends, the distal ends being secured together to prevent water entering therebetween. The splash guards are easy to manufacture, esthetic and ensure that no leakage of water can occur from around a shower curtain.

11 Claims, 2 Drawing Sheets

BATHTUB/SHOWER DEFLECTOR

BACKGROUND OF THE INVENTION

The present invention relates to a splash guard for a bathtub/shower and more particularly, it relates to a splash guard which may be attached to one or more walls surrounding a portion of a bathtub.

Most residences and commercial establishments such as hotels, motels and inns, utilize a bathtub for use both as a conventional bathtub and also as a shower. The bathtub, normally of a rectangular configuration has a shower head provided at one end thereof. While convenient, these bathtub/showers are susceptible to water escaping from the bathtub during the user taking a shower, with the water potentially causing damage, both cosmetic and structural. This is particularly the case in rental accommodations and commercial establishments such as hotels and motels where the users might be inclined to take fewer precautions. Thus, the damage caused by the moisture escaping from the bathtub becomes an economic overhead for the owner.

It is known in the art to provide means of preventing the water from escaping during a shower, the simplest of arrangements comprising a shower rod running parallel to the rim of the bathtub and which is usually braced by spring pressure against two opposing walls of the structure surrounding the tub. A curtain is suspended from the rod, which curtain has at least a portion thereof entering the interior of the tub such that water will stay within the confines thereof. However, in practice, there is frequently leakage from around the curtain particularly since the air in the shower area becomes warmer during the shower and causes an upward air movement. The upward movement of the air means that colder air must enter and this frequently pulls away the shower curtain from the walls and/or rim of the bathtub.

Solid splash guards are also well known and usually comprise flat panels or segments which permit a sliding movement and form a totally enclosed area. However, these solid panels are more expensive and susceptible to breakage. Furthermore, some water can still escape if they are not properly installed and they also become more time consuming to clean. This is particularly a problem in commercial establishments.

SUMMARY OF THE INVENTION

It is an object of the present invention to provide a splash guard arrangement which is adapted to prevent the egress of water from the bathtub/shower area, when used in conjunction with a shower curtain and which splash guard is both effective and is esthetic.

According to one aspect of the present invention, there is provided a splash guard comprising a first vertically extending end wall having a top edge., a bottom edge, and a pair of side edges, a first side wall extending outwardly from the first side edge, a second side wall extending outwardly from the second side edge, the first side wall extending arcuately inwardly to meet the second side wall at their distal ends, and means for securing the first and second side walls together.

In a further aspect of the present invention, in a bathroom having a bathtub and a bathtub enclosure, the bathtub having a pair of bathtub end walls and a pair of side walls, the enclosure having first and second enclosure end walls, the bathtub end walls being adjacent the enclosure end walls, the improvement comprising a splash guard having a first vertically extending end wall secured to the enclosure end wall, first and second side walls extending outwardly from the end wall, the first and second side walls meeting at their distal ends, the second side wall being located proximate an inner peripheral edge of the side wall of the bathtub.

In greater detail, the splash guard of the present invention may be used in conjunction with a bathtub or other enclosure for taking showers. In some instances, it may be used with a stand alone shower enclosure.

The splash guard may be made of any suitable material with a preferred one being a plastics material. It is preferably performed as a one piece extruded unit as will be shown in a preferred embodiment.

The splash guard may also include an end cap placed on the top to prevent the ingress of water.

Having thus generally described the invention, reference will be made to the accompanying drawings illustrating an embodiment thereof, in which:

DESCRIPTION OF THE PREFERRED EMBODIMENTS

Figure 1:
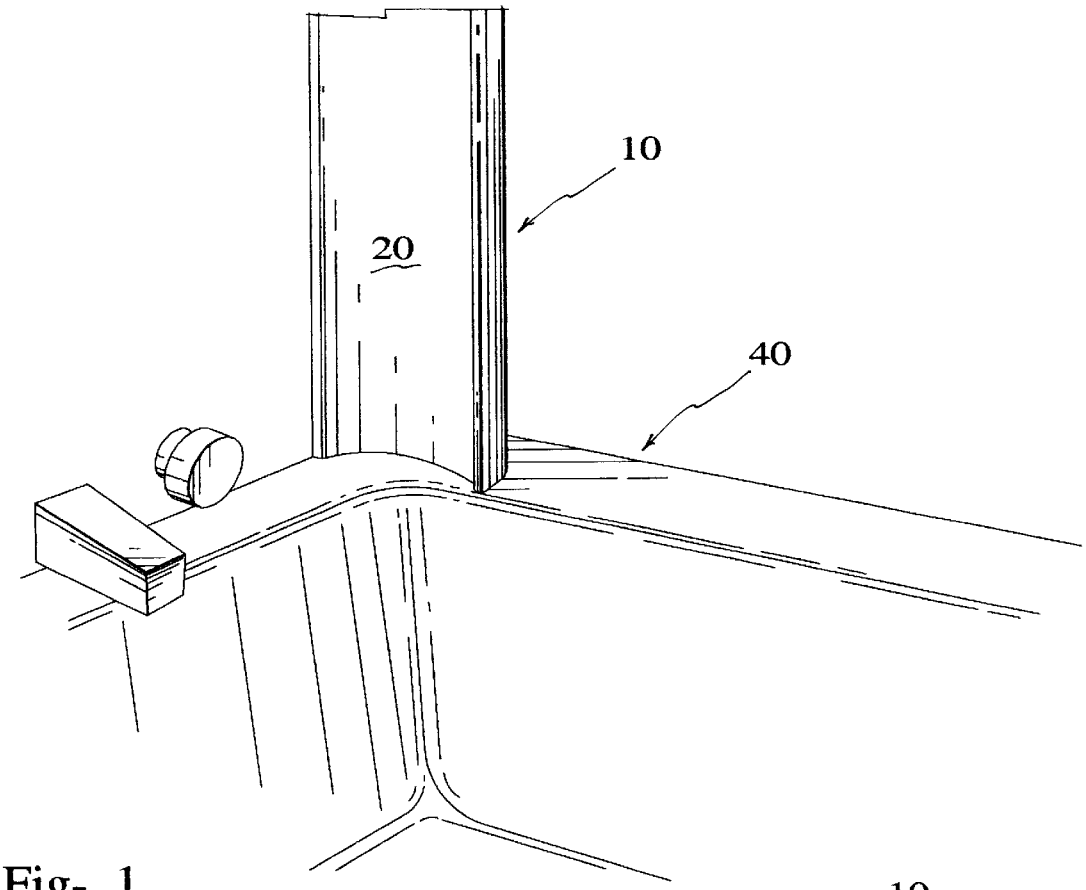
FIG. 1 is a perspective view of a portion of a bathtub illustrating use of the splash guard.

Referring to the drawings in greater detail and by reference characters thereto, a splash guard according to an embodiment of the present invention is generally designated by reference numeral 10. Splash guard 10 has an end wall 12 which is adapted to extend vertically next to an enclosure wall surrounding the bathtub. As may be best seen in FIGS. 3 and 4, at either side of end wall 12 there is provided sealing flanges 14 and 16.

Extending outwardly from end wall 12 on the side thereof opposed to sealing flanges 14 and 16, are a pair of side walls 18 and 20. Side wall 18, at its distal end remote from end wall 12, curves to have an arcuate portion 24 to form an end wall section 22.

End wall section 22 includes an inwardly extending flange 26 which terminates in a hook type element generally designated by reference numeral 28. Side wall 20, at its distal end, also includes a U-shaped portion 30 with a hook element 32 adapted to mate with hook element 28 of end wall 32. Thus, by means of hook elements 28 and 32, end wall section 22 and side wall 20 are secured together.

Extending inwardly from an inner surface of side wall 18 are a pair of spaced reinforcing members 34 and 36. Likewise, a reinforcing spacer member 38 extends inwardly from side wall 20 and is adapted to fit between reinforcing members 34 and 36.

Figure 2:
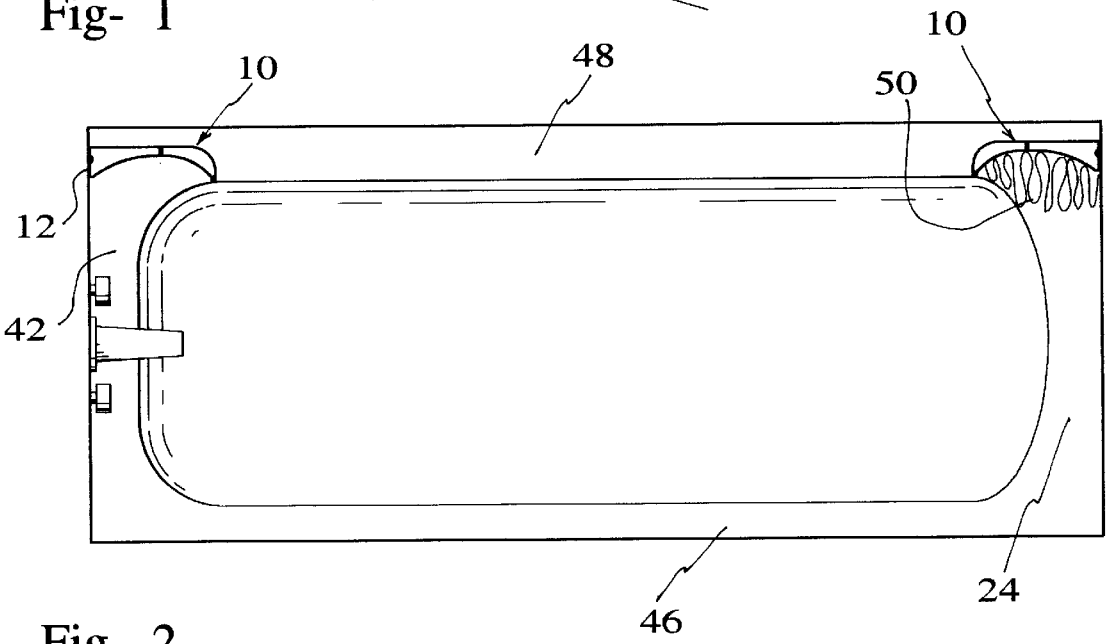
FIG. 2 is a top plan view of a bathtub having a pair of splash guards according to the present invention.

In a typical arrangement, as shown in FIGS. 1 and 2, a bathtub 40 has a pair of opposed end walls 42 and 44 and a pair of opposed side walls 46 and 48. Conventionally, a building wall or other type of surround is present at end walls 42 and 44 and side wall 46 with side wall 48 providing access to the bathtub. Conveniently, a curtain 50 may be provided; the curtain being mounted on a conventional manner on a rod (not shown).

Figure 3:
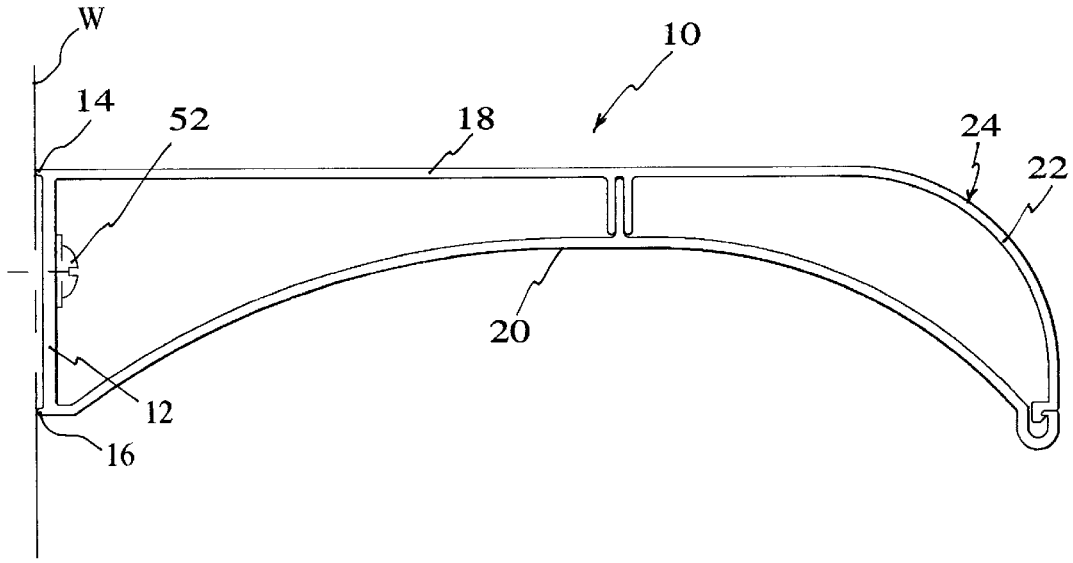
FIG. 3 is a cross sectional view of the splash guard.
Figure 4:
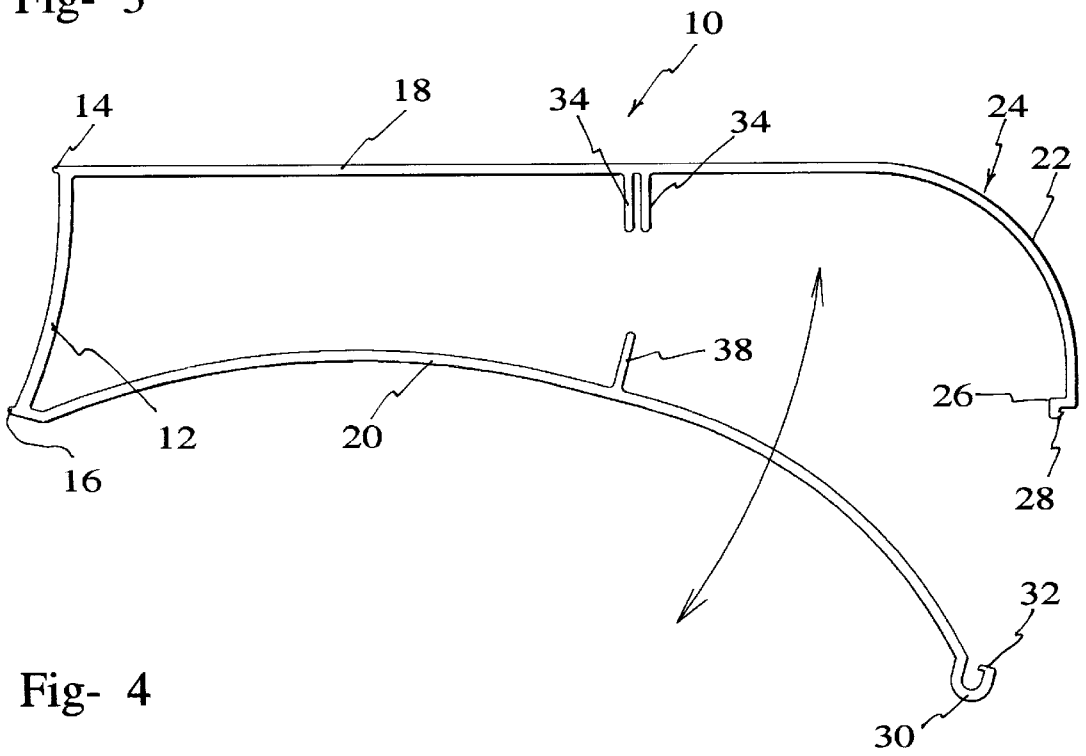
FIG. 4 is a view similar to FIG. 3 illustrating access to the means for mounting the device.

A pair of splash guards 10 are preferably employed, one being associated with each end wall 42 and 44. In this respect, splash guard 10 is secured to an enclosure end wall W by means of a suitable screw 52 or other fastener. In this respect, it will be noted that the splash guards 10 are placed such that the point of joinder of side wall 20 and end wall 22 is situated at the inner marginal edge of bathtub side wall 48. Also, as seen in FIGS. 2 and 3, the point of joinder of side wall 20 and end wall section 22 lies in a plane which is located substantially perpendicular to end wall 12 at a marginal edge thereof. Thus, any water will be retained and run back into the bathtub. It will be noted that sealing flanges 14 and 16 form a seal between end wall 12 and enclosure end wall W.

Splash guards 10 extend inwardly towards each other a distance sufficient that the curtain 50, even if it is slightly free, while have its side edges within the edges of the splash guards 10 and thus prevent water from escaping from the bathtub area.

It will be understood that the above described embodiment is for purposes of illustration only and that changes and modifications made be made thereto without departing from the spirit and scope of the invention.

I claim:

1. A splash guard comprising a first vertically extending end wall having a top edge, a bottom edge, and first and second side edges, a first splash guard side wall extending outwardly from said first side edge, a second splash guard side wall extending outwardly from said second side edge, each of said first and second splash guard side walls terminating in a respective distal end, said second side wall having an overall concave configuration with a first arcuate portion thereof adjacent said second edge extending arcuately inwardly towards said first side wall and a second arcuate portion thereof extending arcuately outwardly, a portion of said first splash guard side wall adjacent its distal end extending arcuately inwardly to meet said second splash guard side wall at their respective distal ends, said second arcuate portion extending outwardly a distance substantially equal to the distance said first arcuate portion extends inwardly towards said first side wall, and means for securing said first and second splash guard side walls together being located proximate said respective distal ends.

2. The splash guard of claim 1 wherein said means for securing said first and second splash guard side walls together comprises a hook type element at their respective distal ends, said hook type elements interengaging each other to thereby secure said first and second splash guard side walls together.

3. The splash guard of claim 1 wherein said splash guard is formed as a single extrusion of a plastic material.

4. The splash guard of claim 1 further including reinforcing means extending between said first and second splash guard side walls intermediate said distal ends of said first and second splash guard side walls and said first end wall.

5. The splash guard of claim 1 further including means for attaching said first end wall to a structural wall.

6. The splash guard of claim 1 further including sealing flanges extending from said end wall in a direction opposed to the direction in which said first and second splash guard side walls extend.

7. In a bathroom having a bathtub and a bathtub enclosure, said bathtub having a pair of bathtub end walls and a pair of side walls, said enclosure having an enclosure end wall, one of said bathtub end walls being adjacent said enclosure end wall, the improvement comprising a splash guard having a first vertically extending end wall secured to said enclosure end wall, first and second splash guard side walls extending outwardly from said end wall, each of said first and second splash guard side walls terminating in a respective distal end, said second splash guard side wall having a concave configuration, said first splash guard side wall extending arcuately inwardly to meet said second splash guard side wall at their respective distal ends, said splash guard side wall distal ends being located proximate an inner peripheral edge of said side wall of said bathtub whereby water contacting said splash guard will flow back into said bathtub.

8. The improvement of claim 7 wherein said splash guard further includes ceiling flanges extending from said end wall in a direction opposed to the direction in which said first and second splash guard side walls extend.

9. The improvement of claim 7 wherein said splash guard is formed as a single extrusion of a plastic material.

10. The improvement of claim 7 wherein said second side wall has a first arcuate portion thereof adjacent said vertically extending end wall extending arcuately inwardly towards said first splash guard side wall and a second arcuate portion thereof extending arcuately outwardly, said second arcuate portion extending outwardly a distance substantially equal to the distance said first arcuate portion extends inwardly.

11. In a bathroom having a bathtub and a bathtub enclosure, said bathtub having a pair of bathtub end walls and a pair of side walls, said enclosure having an enclosure end wall, one of said bathtub end walls being adjacent said enclosure end wall, the improvement comprising a splash guard, said splash guard consisting essentially of a first vertically extending end wall secured to said enclosure end wall, said first vertically extending end wall having a top edge, a bottom edge, and first and second side edges, a first splash guard side wall extending outwardly from said first side edge, a second splash guard side wall extending outwardly from said second side edge, each of said first and second splash guard side walls terminating in a respective distal end, said second side wall having an overall concave configuration with a first arcuate portion thereof adjacent said second edge extending arcuately inwardly towards said first side wall and a second arcuate portion thereof extending arcuately outwardly, a portion of said first splash guard side wall adjacent its distal end extending arcuately inwardly to meet said second splash guard side wall at their respective distal ends, said second arcuate portion extending outwardly a distance substantially equal to the distance said first arcuate portion extends inwardly towards said first side wall, and means for securing said first and second splash guard side walls together being located proximate said respective distal ends, said respective distal ends being located proximate an inner peripheral edge of said side wall of said bathtub whereby water contacting said splash guard will flow back into said bathtub.

* * * * *